US008075264B2

(12) United States Patent
Depaepe et al.

(10) Patent No.: US 8,075,264 B2
(45) Date of Patent: Dec. 13, 2011

(54) BLADE ANGLE SETTING FOR A TURBOMACHINE

(75) Inventors: David Robert Gilbert Depaepe, Herstal (BE); Philippe Ernst, Eupen (BE)

(73) Assignee: Techspace Aero, Milmort Herstal (BE)

( * ) Notice: Subject to any disclaimer, the term of this patent is extended or adjusted under 35 U.S.C. 154(b) by 1025 days.

(21) Appl. No.: 11/962,852

(22) Filed: Dec. 21, 2007

(65) Prior Publication Data

US 2008/0206049 A1 Aug. 28, 2008

(30) Foreign Application Priority Data

Dec. 22, 2006 (EP) ..... 06292026

(51) Int. Cl.
*F01D 9/04* (2006.01)

(52) U.S. Cl. ..... 415/209.3; 415/191; 415/211.2; 415/213.1

(58) Field of Classification Search ..... 415/199.5, 415/191, 209.3, 209.4, 210.1, 211.2, 213.1
See application file for complete search history.

(56) References Cited

U.S. PATENT DOCUMENTS

| | | | | |
|---|---|---|---|---|
| 2,488,875 | A * | 11/1949 | Morley | 415/136 |
| 2,755,064 | A * | 7/1956 | Simonsen | 415/209.3 |
| 2,834,537 | A * | 5/1958 | Neary | 415/209.2 |
| 4,643,636 | A | 2/1987 | Libertini et al. | |
| 6,296,442 | B1 * | 10/2001 | Tran | 415/189 |

FOREIGN PATENT DOCUMENTS

EP 0 953 729 A1 11/1999

* cited by examiner

*Primary Examiner* — Ninh H Nguyen
(74) *Attorney, Agent, or Firm* — Oblon, Spivak, McClelland, Maier & Neustadt, L.L.P.

(57) ABSTRACT

A straightener blade for a turbomachine, comprising a platform arranged at a radially external end of the blade and adapted to be engaged in a annular groove of a housing, and a threaded rod radially extending outwardly from the platform and adapted to pass through an orifice of the housing in order to receive a fixing nut, the upstream and downstream edges of the platform each comprising a protrusion extending in the plan of the platform in order to limit the rotation of the platform in the groove when the nut screwed on the threaded rod is tightened.

9 Claims, 2 Drawing Sheets

BLADE ANGLE SETTING FOR A TURBOMACHINE

The present invention relates to straightener blades for a turbomachine, such as particularly a plane turbo-jet.

In a know manner, a straightener blade comprises an airfoil connected at its radially external end to a platform with a threaded rod radially extending outwardly from the platform. The upstream and downstream edges of the platform are engaged in an annular groove formed in the inner surface of a substantially cylindrical housing, with the rod inserted in an orifice provided in the bottom of the groove. The blade thus positioned is angularly set by the platform abutting against the groove-flanks. A nut is screwed on the threaded rod to secure the blade on the housing. Tightening the nut provided on the housing allows the straightener blade to be maintained in a fixed position such as to provide the best straightening function for the air flow through the turbomachine.

In the current technique, in order to position the platform of the blade in the groove, the nominal width of the platform, i.e., its nominal dimension in the longitudinal plan of the turbomachine is shorter than the nominal width of the groove, thus involving a minimum clearance of the platform fitted in the groove. Tightening the fixing nut generates an angular shifting for the platform of the blade, which is more or less important due to the manufacturing tolerances of the groove of the housing and the platform. Thus, the airfoil of the blade is positioned with an angular shifting from its theoretical position and then does not optimally provide straightening for the air flow through the turbomachine any more. The angular shifting of a plurality of straightener blades may thus lead to an efficiency and efficacy loss for the turbomachine.

Today, the angular setting of the straightener blades on the housing requires important means in terms of tooling and control, causing this mounting step to be more costly and labour intensive. Lessening the manufacturing tolerances for platforms of the blades and grooves of the housing cannot be an envisaged solution insofar as it would considerably increase the manufacturing costs.

It is therefore important to improve the angular positioning of the blade in the groove in order to provide an optimal positioning for the airfoil of the blade relative to the air flow while maintaining the same manufacturing tolerances.

Straightener blades are further described in U.S. Pat. No. 2,755,064, which comprise platforms with non-circular contours located in orifices having a conjugate shape to that of the platforms that are provided in a fixedly mounted ring in a groove of the housing, this mounting allowing the straightener blades to be positioned in a predetermined orientation but not taking the variations due to the manufacturing tolerances of the blades, rings and grooves of the housing into account.

The invention aims to improve the angular setting of the blade in the groove in a simple, efficient and cost effective manner.

It proposes therefore a straightener blade for a turbomachine comprising a platform arranged at a radially external end of the blade and adapted to be engaged in an annular groove of an inner surface of a housing, and a threaded rod radially extending outwardly from the platform and adapted to pass through an orifice of the housing in order to receive a fixing nut external to the housing, characterised in that the upstream and downstream edges of the platform each comprise a protrusion extending in the plan of the platform to limit the rotation of the platform in the groove when the nut screwed on the threaded rod is tightened.

Providing protrusions on the upstream and downstream edges of the platform allows a platform whose nominal width is equal to the nominal width of the groove to be engaged in the groove of the housing. Therefore, there is no more minimum clearance between the platform and the groove. The angular shifting between those two pieces after screwing the nut is lessened and only depends on the manufacturing tolerances. The invention then allows an improvement for positioning the blade while maintaining the same manufacturing tolerances.

Advantageously, the platform is substantially rectangular and one protrusion is located at an end of the upstream edge of the platform, and the other one is substantially symmetrical to the first one relative to the platform-centre.

Positioning the protrusions at the opposite ends of the upstream and downstream edges of the platform, i.e., at opposite vertex of the platform, allows an optimum tightening torque to be obtained when the nut is screwed on the threaded rod while preventing any marking piece-caulking effect.

According to another feature of the invention, the protrusions are formed on the ends of the platform-edges which are adapted to rest on the flanks of the groove when the fixing nut is tightened.

In one preferred embodiment of the invention, the protrusions are substantially rectangularly shaped and have a dimension toward the groove-flanks defined according to the clearance required for mounting the platform in the groove, taking tolerances of the width of the groove and platform into account.

In an alternative of the invention, the threaded rod is connected to a centre part of the platform forming an oversized portion relative to the upstream and downstream edges of the platform, with the oversized portion being able to form a circular area centred on the rod axis.

The protrusions and the oversized portion of the platform can be produced by machining, for example.

The invention also relates to a turbomachine, such as a plane turbo-jet, characterised in that it comprises straightener blades of the above disclosed type.

Further advantages and features of the invention will be apparent when reading the following description, given by way of non limiting example, and referring to the accompanying drawings, in which.

Figure 1:
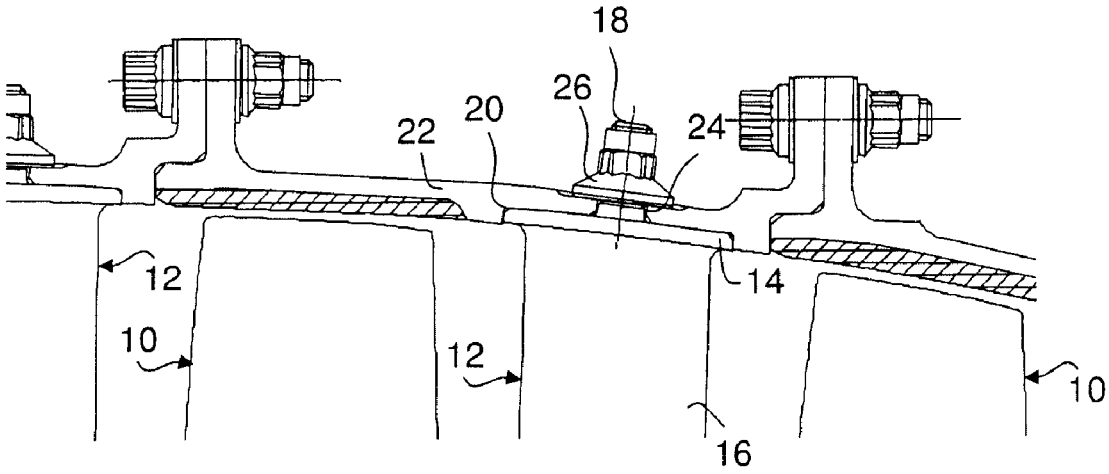
FIG. 1 is a schematic partial cross sectional view illustrating the straightener blade mounting in a groove of a housing.

Referring first to FIG. 1, movable blades 10 and fixed blades 12 alternately arranged such as, for example, in a turbomachine compressor are illustrated. The movable blades 10 are connected to a rotor in the radially inner part thereof, with the fixed blades 12 secured to a housing in the radially inner and radially external parts thereof.

A fixed blade comprises a substantially rectangular platform 14 connecting the radially external end of an airfoil 16 to a threaded rod 18 radially extending outwardly from the platform. The platform 14 is engaged in an annular groove 20 of the inner surface of a housing having revolution geometry 22 and fixedly maintained in the groove by the rod 18, which is inserted in a radial orifice 24 of the housing 22. Fixing nuts 26 are screwed on the rods 18 in order to provide the blade-tightening on the housing 22.

During operation of the turbomachine, the movable blades and fixed blades cooperate to draw-in air trough the various parts of the engine. The fixed blades (further referred as straightener blades) operate to straighten the air flow trough the turbomachine. Thus, the orientation of the airfoils 16 of the straightener blades 12 relative to air flow is critical to provide the optimum operation of the turbomachine.

Figure 2:
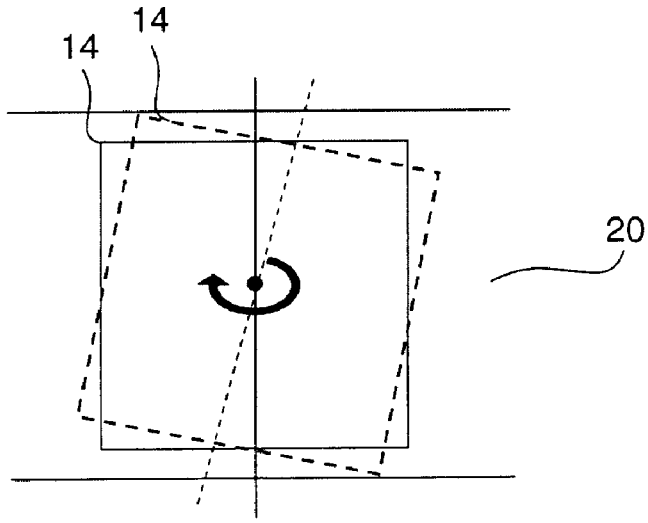
FIG. 2 is a schematic view seen from above of a straightener blade fixed in a groove of the housing and illustrating the angular shifting of the blade when the blade is tightened according to the prior technique.

In the known technique, as shown in FIG. 2, minimum clearance should be provided between the groove 20 and the platform 14 of the blade in order to insure insertion of the platform 14 in the groove 20. Therefore, the nominal width of the platform, i.e., its nominal dimension in the axis of the turbomachine must imperatively be shorter than the nominal width of the groove 20. Thus, the mounted blade 12 is angularly shifted in the groove 20 after the nut 26 is screwed on the housing. This shifting is more or less important whether the actual widths of the platform and groove are in the upper or lower limits of manufacturing tolerances. In order to insure a suitably angular setting of the straighteners, important means are required in terms of tooling and orientation control of the platforms of the blades, thus causing the straightener blade-fitting operation to be costly and time consuming.

Figure 3:
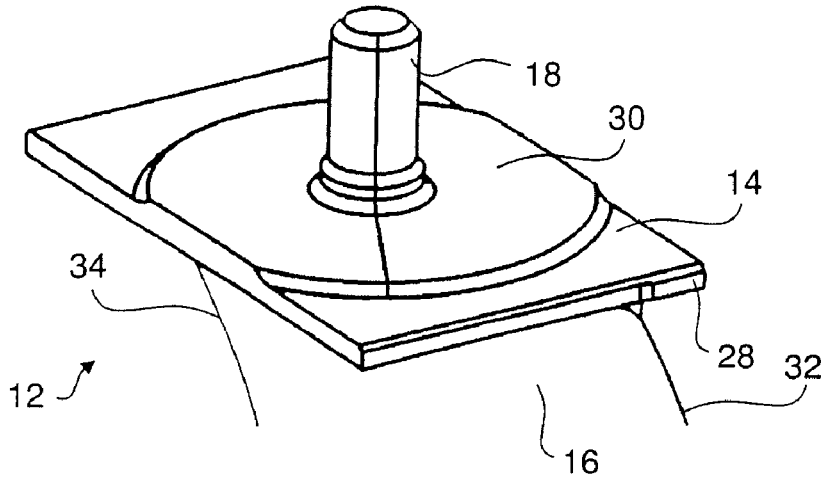
FIG. 3 is a schematic perspective view of a straightener blade according to the invention.
Figure 4:
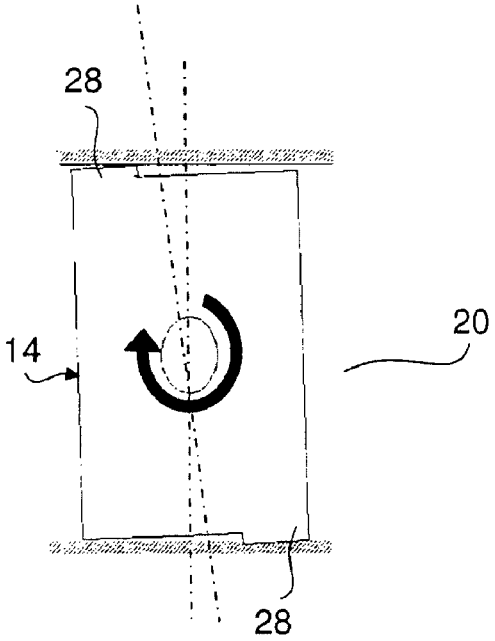
FIGS. 4 and 5 are schematic views seen from above of a platform of a blade according to the invention, with two cases illustrated.
Figure 5:
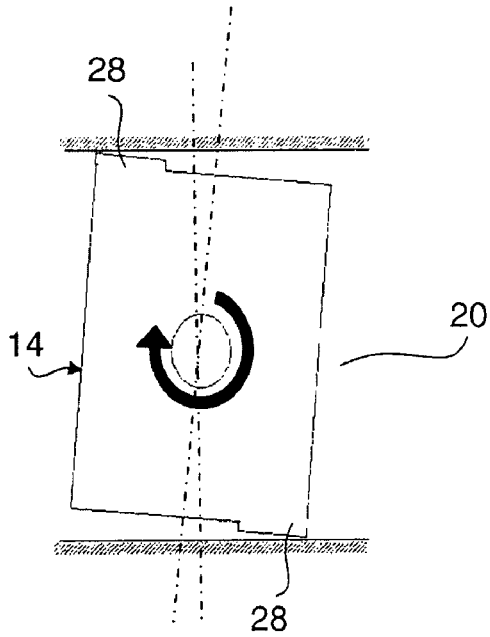

As shown in FIGS. 3 to 5, the invention proposes protrusions 28 to be formed at the ends of the upstream and downstream edges of the platform to lessen the angular shifting of the straightener blades during the mounting operation, with those protrusions extending in the plan of the platform.

In the embodiment of FIGS. 3 to 5, those protrusions 28 are substantially rectangularly shaped and symmetrically located at two vertex of the platform 14 relative to the centre thereof. Those are the two vertex which rest on the flanks of the groove when the tightening of the fixing nut rotates the blade-platform in the groove, and the protrusions are located at the ends of the upstream and downstream edges of the platform which extend away from those two vertex. Such positioning of the protrusions allows a maximum tightening torque at the fixing nut of the blade when the protrusions rest on the flanks of the groove.

Providing protrusions 28 at the ends of the upstream and downstream edges of the platform allows the platform 14 of the blade 12 to be dimensioned such that its nominal width equals the nominal width of the groove 20. Two cases can be distinguished, whether the actual width of the platform is shorter or longer than the actual width of the groove owing to the manufacturing tolerances of the pieces.

FIG. 4 shows the case when the actual width of the platform 14 is longer than the actual width of the groove 20. The rotation of the blade 12 reverse to the tightening direction allows the axial bulkiness of the platform 14 to be lessened, such as it is shorter than the actual width of the groove 20. Thus the insertion of the platform 14 in the groove 20 can be carried out.

FIG. 5 shows the case in which the actual width of the platform is shorter than the actual width of the groove 20. The insertion of the platform 14 in the groove 20 is not difficult at all and a mounting configuration like in prior art can be then provided.

With the abovementioned two cases, one can obtain a lessened maximum angular shifting for the blade relative to the theoretical position. This lessening is more than 50% to that of a platform without protrusions, while maintaining the same manufacturing tolerances as in prior art. The invention also allows a blade whose actual width of the platform equals the nominal width of the groove not to exhibit any angular shifting when the fixing nut is tightened, which is impossible with a prior art blade.

The dimensions of the protrusions 28 must be chosen according to the manufacturing tolerances of the pieces in such a manner that the insertion of the platform 14 in the groove 20 is always possible. Specifically, to avoid additional stress areas to be generated, it is important for the length of the protrusions 28 to be long enough to provide the contacts between the platform 14 and groove 20 at the protrusions 28 and not at the vertex of the platform 14, which do not comprise protrusions.

The protrusions of the platform can both have the same width or dimension in the longitudinal plan of the turbomachine, defined in relation to the clearance required for the mounting of the platform in the groove taking tolerances on the width of the groove and platform into account.

In the embodiment of the invention shown in the drawings, the width of each protrusion is from about 0.2 to 0.3 mm and its length is about 5 mm. Those dimensions are given by way of example for a platform and a groove having a nominal width of about 50 mm, with the lateral dimension of the platform being of about 30 mm.

Advantageously, the platform comprises an oversized portion 30 forming a circular area centred on the axis of the threaded rod 18. The contact between the platform 14 and the housing 22 is thus limited to the oversized portion 30 and does not extend to the upstream and downstream edges of the platform, which allows the stresses applied on the leading edge 32 and trailing edge 34 of the airfoil 16 due to the tightening operation of the threaded rod 18 on the housing 22 to be lessened.

The protrusions as well as the oversized portion can be produced by machining.

The invention has thus a particular interest in that it allows an improvement for the initial positioning of a blade in a groove of a housing, while maintaining the same manufacturing tolerances.

The previously described invention can be used in all the compartments of the turbomachine requiring an accurate angular positioning of the straightener blades. The invention is not limited to the only one shape of protrusions described and illustrated and others shapes can also be envisaged.

The invention claimed is:

1. A straightener blade for a turbomachine, comprising a platform arranged at a radially external end of the blade and adapted to be engaged in a annular groove of an inner surface of a housing, and a threaded rod radially extending outwardly from the platform and adapted to pass through an orifice of the housing in order to receive a fixing nut external to the housing, characterised in that the upstream and downstream edges of the platform each comprise a protrusion extending in the plan of the platform to limit the rotation of the platform in the groove when the nut screwed on the threaded rod is tightened.

2. A blade according to claim 1, characterised in that the platform is substantially rectangular and one protrusion is located at an end of the upstream edge of the platform, and the other one is substantially symmetrical to the first one relative to the centre of the platform.

3. A blade according to claim 1, characterised in that the protrusions are formed on the ends of the edges of the platform which are adapted to rest on the flanks of the groove when the fixing nut is tightened.

4. A blade according to claim 1, characterised in that the protrusions are substantially rectangular shaped.

5. A blade according to claim 1, characterised in that the protrusions have a dimension toward the flanks of the groove defined according to the clearance required for mounting the platform in the groove taking tolerances of the width of the groove and platform into account.

6. A blade according to claim 1, characterised in that the threaded rod is connected to a centre part of the platform forming an oversized portion relative to upstream and downstream edges of the platform.

7. A blade according to claim 6, characterised in that the oversized portion forms a circular area centred on the axe of the rod.

8. A blade according to claim 6, characterised in that the protrusions and the oversized portion of the platform are produced by machining.

9. A turbomachine, such as a plane turbo-jet, characterised in that it comprises straightener blades according to claim 1.

* * * * *